United States Patent [19]

McMullan

[11] 4,279,526

[45] Jul. 21, 1981

[54] RECTANGULAR CONTAINER/APPLICATOR PACKAGE FOR DIMENSIONALLY STABLE SOLID PAINTS AND RELATED MATERIALS

[75] Inventor: Robert G. McMullan, Oakville, Canada

[73] Assignee: SCM (Canada) Limited, Don Mills, Canada

[21] Appl. No.: 10,382

[22] Filed: Feb. 8, 1979

[51] Int. Cl.[3] ..... B43K 19/14

[52] U.S. Cl. ..... 401/97; 206/602

[58] Field of Search ..... 401/97, 96, 49, 91, 401/88, 86, 87; 426/110, 112, 115, 122, 123, 124, 130, 134, 394; 206/606, 627, 526, 527, 602; 229/37–39, 43

[56] References Cited

U.S. PATENT DOCUMENTS

| | | | |
|---|---|---|---|
| 2,318,152 | 5/1943 | Gelardin | 401/87 |
| 2,469,631 | 5/1949 | Broder | 401/87 |
| 2,852,179 | 9/1958 | Bieler | 206/627 |
| 3,539,093 | 11/1970 | Massengill | 206/606 |
| 3,680,764 | 8/1972 | Young et al. | 206/633 |
| 3,846,029 | 11/1974 | Benn et al. | 401/96 |
| 3,967,773 | 7/1976 | Kaufmann | 206/606 |
| 4,073,950 | 2/1978 | Hansen et al. | 426/122 X |

FOREIGN PATENT DOCUMENTS

| | | | |
|---|---|---|---|
| 354600 | 7/1905 | France | 401/97 |
| 972125 | 1/1951 | France | 401/97 |
| 18819 | of 1914 | United Kingdom | 206/606 |

*Primary Examiner*—Robert W. Michell
*Assistant Examiner*—J. L. Kruter
*Attorney, Agent, or Firm*—A. Joseph Gibbons

[57] ABSTRACT

A new concept in painting various substrates is implemented by rectangular container/applicator packages having the capability of storing solid paint and other dimensionally stable materials while additionally functioning as a useful applicator. Such applicators are advantageous in that they allow painting without conventional brushes, rollers and similar implements and are readily disposable.

5 Claims, 8 Drawing Figures

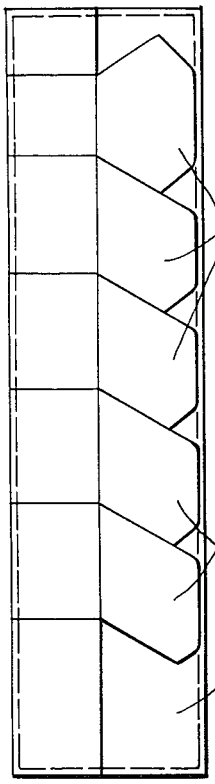
Fig. 1
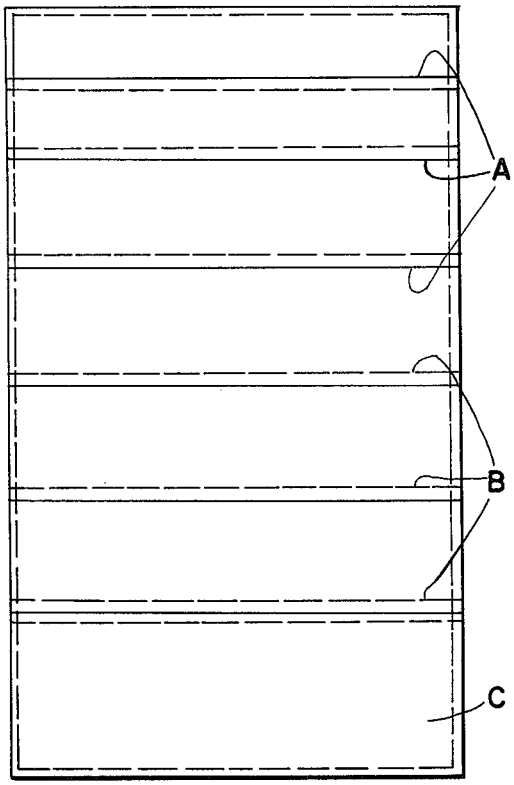
Fig. 2
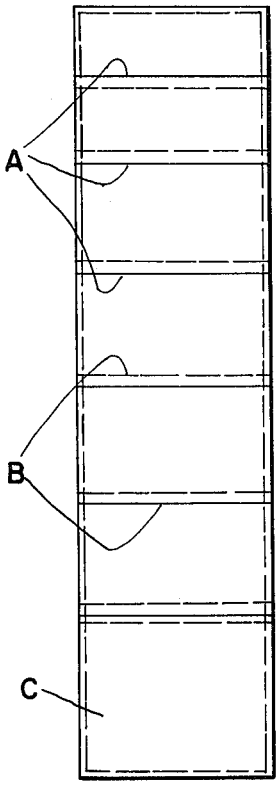
Fig. 3
Fig. 4
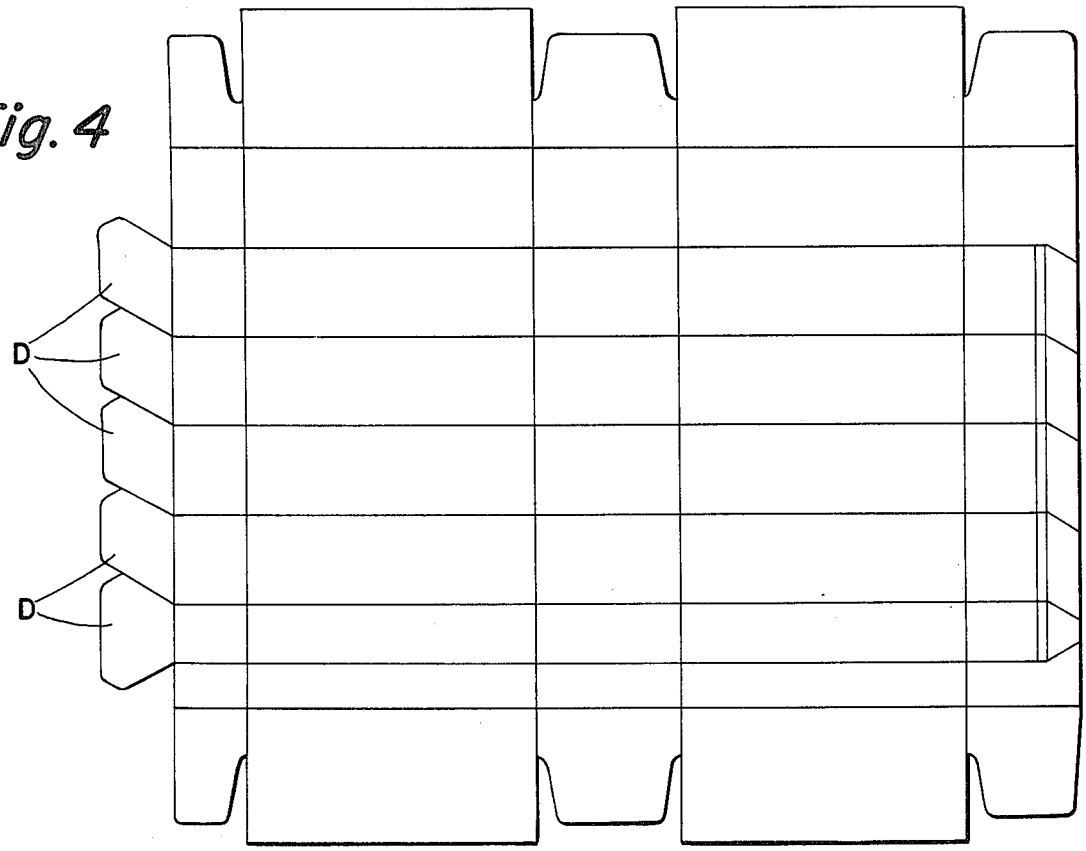

RECTANGULAR CONTAINER/APPLICATOR PACKAGE FOR DIMENSIONALLY STABLE SOLID PAINTS AND RELATED MATERIALS

BACKGROUND OF THE INVENTION

Within the last few years new non-conventional types of paint products having dimensional stability based on ion-bonding were developed. These new products, called Solid Paints, differed considerably from conventional paints of the prior art in that unique gel properties resulted from cross-linking of certain reactive polymers with "ion clusters" having polar molecule components. Such Solid Paints having non-volatile contents on the order of 40–85 weight-percent and gel strengths on the order of 75–175 mm of penetration as measured by a Universal Penetrometer are exemplified in U.S. Pat. Nos. 3,994,849; 3,994,848 and 4,078,116.

Because of the unusual properties of these solid (gel) paints, conventional application tools were not useful. A need thus arose for a suitable container to house the new solid paint product which would allow the convenient application of these coatings to various substrates. This invention relates to a rectangular container/applicator package for dimensionally stable solid paints and related materials having high gel strengths. Since products of this nature have not heretofore been known, the closest art known to Applicant is that shown for bias angle container/applicators in the sister application #16001 filed concurrently with the instant case.

BRIEF SUMMARY OF THE INVENTION

One object of the present invention is to provide a disposable rectangular or square container/applicator for solid paint useful for painting or coating of various substrates.

A primary object is to provide a container/applicator package for storing and applying dimensionally stable solid materials deformable on contact with a surface on which said material may be deposited as a coating or treatment which comprises:

(a) an assembled outer shell formed from a one-cut unfolded package as depicted in FIG. 4 and having one or more individually horizontally positioned removable tear strips where by the dimensionally stable and deformable solid material may be exposed for application to a substrate;

(b) an inner lining firmly bonded to the outer shell which functions as a barrier to contain the solid deformable material and to prevent diffusion of air into the package which would undesirably lead to oxidation and the formation of paint skins;

(c) a false bottom which functions to anchor the dimensionally stable solid material to the package and so prevents the dislocation of the material from the package particularly when the gel nears exhaustion with consequent soiling of the surroundings.

Further objects include applicators of the above type wherein the dimensionally stable deformable solid material is a solid paint, a solid adhesive, a caulking compound, sealant and other deformable materials having gel strengths on the order of 75 to 250 mm of penetration on a Universal Penetrometer.

BRIEF DESCRIPTION OF THE DRAWINGS

FIG. 1 is a scaled drawing of one side showing the tear tabs and FIG. 3 is a drawing of the opposite side of a rectangular container/applicator package.

FIG. 2 is a scaled front view of the package.

FIG. 4 is a scaled drawing of the outer surface of an unfolded package showing tear tabs and die-cut perforations.

DETAILED DESCRIPTION OF THE INVENTION

Figure 5:
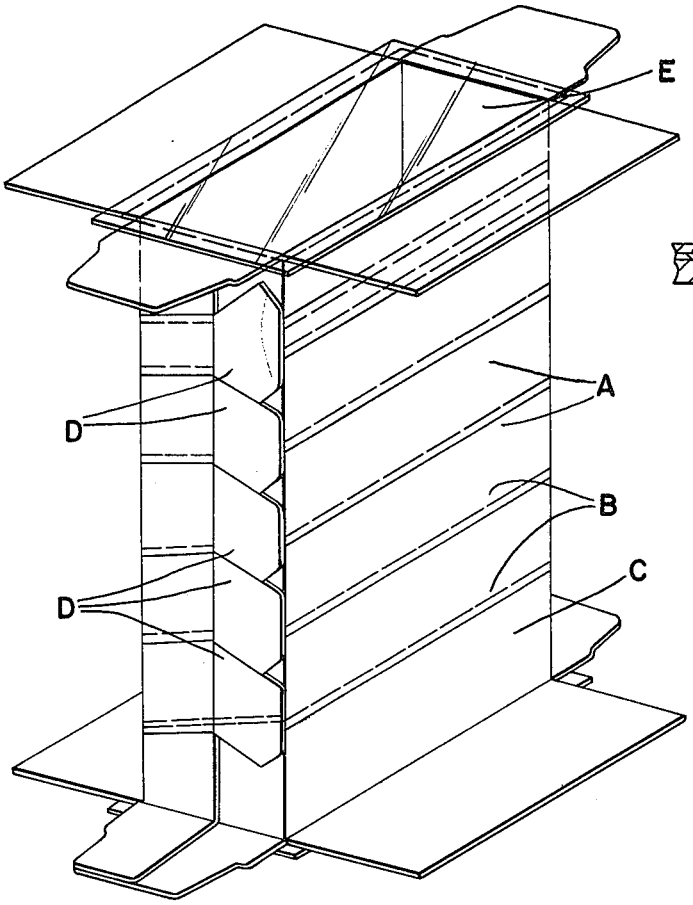
FIG. 5 is a drawing of the partially assembled package and a perspective view showing internal and external die-cuts.

The container/applicator of the present invention represents a major advancement in the paint and coating art and was developed primarily to accommodate a new concept in paints, i.e. solid paints, as exemplified in U.S. Pat. Nos. 3,994,848; 3,994,849; 4,078,116; and Ser. No. 725,633 filed Sept. 22, 1976. These solid paints are self supporting and exhibit gel strengths of about 75–175 mm penetration as measured on a Universal Penetrometer. They can be mold formed in various shapes and sizes.

The package is made from standard card material approximately 0.020" thick having a foil laminate inside surface and so constructed that the material can be peeled away at specific intervals to expose the product as required. The tear-away strips, which are the unique feature of the package, are accomplished by the method of die cutting allowing the material to be peeled away leaving a clean sharp edge.

The card is die cut halfway through the thickness on one side and then turned over and die cut halfway through again. This second die cut operation is spaced approximately 3/32" away from the previous cut. This maintains a physically strong piece of material but allows it to break away when pulled by the tabs which are designed into the package. The package is then formed in a conventional manner. The main feature of the package is that it is a controlled disposable container which is rectangular or square in shape. The combination of the above features make this a very inexpensive and practical way of dispersing these gel products.

The instant invention is specifically exemplified by a detailed consideration of the various drawings.

FIGS. 1, 2 and 3 present a front view and two side views of the assembled rectangular container/applicator showing the relative positions of the component parts of the package. The external die-cut perforations (A) are indicated by a solid line. Internal die-cut perforations (B) are shown as dotted lines. It is noted that the internal and external die-cut lines are spaced apart from one another and this feature allows each tear strip to be readily removed as the exposed paint area is depleted to give a clean tear with a minimum of ragged edges. The false bottom insert (C) serves several functions in the overall invention. One function of the false bottom is to anchor the solid paint to the package. Another function of the bottom is to serve as a handle for holding the solid paint during the application of same to the substrate to be painted or treated. A third and extremely advantageous function of the false bottom is to conserve paint so that a substantial amount of the paint in the container becomes available for useful painting. This specific aspect of conservation is more readily understood by referring to the structural components depicted in FIGS. 7 and 8.

The tear tab handles (D) are shown in FIG. 1. These allow the individual tear strips to be removed for the purpose of exposing a useable quantity of solid paint. Although the particular container depicted represents a solid paint volume content of approximately 150 cc, the container is readily manufactured in different useable sizes and the invention should not be limited to any one volume or dimension. The shape of the tear handle (tab) can be varied so long as it is readily grasped to easily remove the tear strip. The shape depicted with the tear tab at a 30 downward bias is particularly advantageous in that it positions the operator's hand remote from the wet paint when peeling away the tear strips. In a similar fashion the number of tear strips will be determined by the height and/or volume of the particular holder applicator.

FIG. 4 illustrates a layout of an unfolded double die-cut 65 mm package having multiple tear strips and shows the relative positions of the tear tabs (D) and the external die-cut lines (A) necessary to allow exposure of the consumable material. Also illustrated is the relative dimensions of the various tabs and fold lines necessary to enable assembly of the one-piece container. Although various materials may be utilized for the outside surface, 20 pt. cylinder board is particularly advantageous for the purposes of the instant invention. In this figure only the external die-cut lines are indicated. Additional die-cut lines displaced from and parallel to the external die-cut lines, are made on the inside of the cardboard as earlier indicated in FIGS. 1, 2 and 3. The depth of the inside and outside die-cut lines is equal to one-half the thickness of the board. The foldable flaps are cut completely through to within 1.5 mm of the crease line. Prior to painting the top shear strip is peeled away allowing the package top to be removed exposing a useable portion of solid paint. The paint is then applied to the various substrates by holding the container in such fashion that the exposed paint surface is in contact with the substrate to be coated. Using a variety of hand movements sufficient pressure is applied to deform the gel material in contact with the substrate whereby a coating is applied to the substrate. Just as in conventional painting, the thickness of the paint film depends on the number of times the solid paint is drawn across the surface and in part on the pressure exerted at the point of contact.

The present invention is further illustrated by FIG. 5 which depicts a partially assembled container applicator. FIG. 5 shows the relative positions of the false bottom (C), the external tear strips (A) and the tear tabs (D). It is understood that dimensionally stable, deformable material will occupy the position between the top of the container and the false bottom. The top and bottom ends are further sealed with a barrier (E) prior to respective end closure.

The barrier seals include a variety of plastic and metal foil materials either taken alone or in combination. The barrier end seals are advantageously heat sealable thermoplastics or laminates which serve to contain the solid paint and prevent air oxidation. Suitable barriers include laminates consisting of polyester/polyvinylidene chloride/polyethylene and the like. A plastic laminate consisting of nylon/polyvinylidene chloride/polyethylene and 0.0003 to 0.001 inch aluminum foil is especially preferred. The aluminum foil is advantageously sandwiched between layers of the plastic material. The end barriers are sealed to the package by conventional sealing techniques. Although the container may be filled either from the top or bottom after proper sealing of the opposite end, the dimensionally stable solid is advantageously added from the bottom with the container in an inverted position followed by placement of the false bottom, sealing and closure of the bottom tabs.

Figure 6:
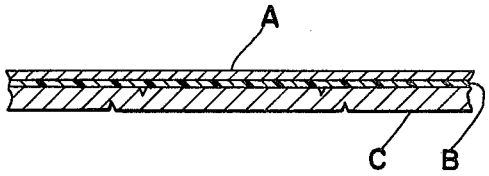
FIG. 6 is a cross-sectional view of the external cylinder board with aluminum foil lining bonded thereto.

FIG. 6 shows an advantageous inner lining consisting of a 0.0008 inch aluminum foil barrier (A) laminated to the outer paperboard shell (C) via a thermosealing polycoat (B). The polycoat acts to thermally bond the foil layer to the cardboard material. Although numerous polycoat materials may be used a polyethylene extrusion coated to the paperboard is preferred. Similar polycoats can also be used to heat seal the end flaps of the container. It is important to note the off-set positions of the external and internal die-cuts in the cylinder board and the interposition of a poly interface between the outer cylinder board and the internal foil lining (barrier). Although the inner lining may be completely separate from the external container, it is preferably bonded to the outer package. In a preferred system the die-cuts are made on the inner surface of the paperboard or cylinder board, the aluminum foil is then bonded to the inner surface and die-cuts are then made on the external surface of the paperboard. Suitable liners which make effective barriers include cellulosics, polycarbonates, polypropylene, polyester or metallized plastic sheet material. Aluminum foils of about 0.0003 to 0.001 inch thickness are especially preferred. The liner must have the ability to propagate a tear after nipping.

Referring further to the false bottom, it is noted that this insert may be fabricated from various materials including cardboard, wood, coated paper and plastic materials provided these structures are capable of performing the functions required by said insert. The false bottom anchors the dimensionally stable solid material to the package and prevents dislocation of the gel material. Such insert also contributes stability to the overall package and lends support to prevent deformation on storage and shipment. A particular advantageous function of the insert is that it allows the applicator to be firmly gripped and held in the hand of the person using said applicator in dispensing the contents to a substrate surface. An additional function of the insert is to hold the paint block firmly in place as the solid material is consumed by application to a substrate and the various tear strips are consecutively removed.

Figure 7:
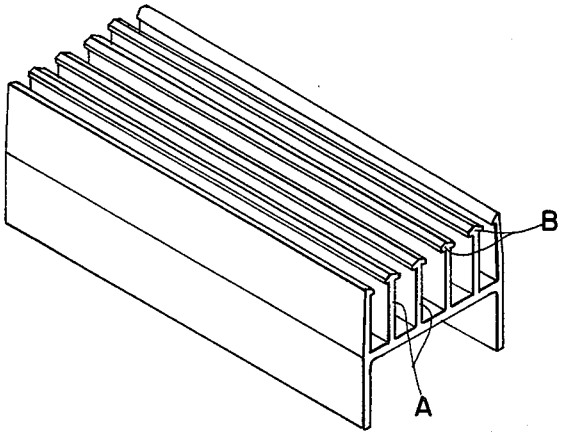
FIG. 7 is a drawing of a rectangular shaped false bottom.
Figure 8:
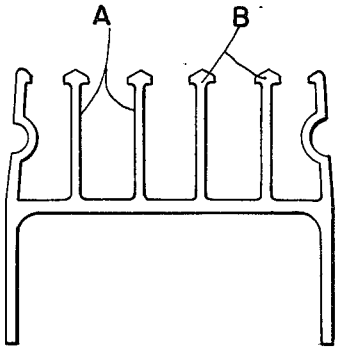
FIG. 8 is an end view of the false bottom.

The specific design of the false bottom insert shown in FIG. 7 accomplishes all of the above functions. Although other types of structural ribs can be employed including individual spikes, spurs, or holding components of various design, the rib section structure with enlarged upper spur portion, illustrated as A and B respectively in FIGS. 7 and 8 is particularly advantageous in holding the heal of the solid material essentially in place. This structural feature thus allows maximum paint utility and conservation and prevents the premature dislodging of the paint heal as the material is depleted. As shown in FIG. 7, the insert comprises a base structural section containing two legs and a top section having a plurality of ribs with enlarged spur portions positioned lengthwise parallel to two side panels. The side panels may be an extension of the leg portion base. It is appreciated that for small to medium size applicator packages, the top spur portion can retain essentially the same dimensions while the leg portion and width can be modified to accommodate the various package sizes. As the package size becomes larger, more structural ribs may be added. For large packages exceeding one quart capacity additional leg positions may be necessary to provide adequate support.

The outer spurs, adjacent to the package sides, are preferably angled at about 4 degrees from the vertical position toward the center. This allows the liquid paint to flow between the package wall and the spur at the time of filling. When the paint solidifies, the gel bonds and anchors the false bottom to the package wall. The outer spurs may advantageously contain a cavity portion which enhances the bond.

For purposes of this invention, the words "spur" and "spike" include t's, y's, arrows and other spike-like protrusions as well as their linear projections. Such spur components which extend into the dimensionally stable gel may be arranged in various patterns or designs.

What I claim is:

1. A rectangular box-like container applicator-package for storing and applying a solid, generally rectangular, dimensionally stable block of a gel that is deformable on contact with a surface on which said gelled material may be deposited by wiping an exposed edge of the gel block over the surface while pressing it against the surface, which package can serve when opened as an applicator-holder for the gel block, said container package comprising sheet material and having a series of lines of weakness circumscribing the perimeter of the container and spaced from each other, said lines of weakness being parallel to one end of the container and to each other, and arranged perpendicular to the longitudinal axis of the container, said lines of weakness defining a series of strips there between respectively, each strip being individually removable from the container, whereby one end strip of the box-like container may be removed to open said package and to expose one end of the gel block for use, while the other end of the container may be grasped to permit use of that end of the container as an applicator handle for the gel block, said container having disposed therein, at the end thereof to be grasped, a false bottom structure, said false bottom structure including a base portion that conforms to the shape of the container wall and is engaged against it at the end of the package that is to be grasped and that reinforces the container against pressure that may be exerted while grasping the container to apply the gel, said false bottom structure also being provided with means that project from said base portion into and that are embedded in the gel block to secure the gel block against movement relative to said false bottom structure, wherein said means comprise a plurality of ribs with enlarged upper spur portions that project into the interior of the package and into the gel block from said base portion of the false bottom structure.

2. The paint package of claim 1 wherein said sheet material is a laminate of cardboard and aluminum foil, the cardboard providing the outer surface of the container and the aluminum foil providing an inner liner of the container.

3. The package of claim 1, each said rib having an enlarged portion at the upper end thereof that is embedded in the gel block, the better to secure the block to the false base structure.

4. The applicator-package of claim 1 wherein the deformable gel is a solid paint.

5. The applicator-package of claim 1 wherein the deformable gel is a solid adhesive.

* * * * *